US009297560B2

(12) United States Patent
Park et al.

(10) Patent No.: US 9,297,560 B2
(45) Date of Patent: Mar. 29, 2016

(54) DEHUMIDIFIER FOR A COMPRESSOR IN COMPRESSION-ABSORPTION HEAT PUMP SYSTEM

(71) Applicant: KOREA INSTITUTE OF ENERGY RESEARCH, Daejeon (KR)

(72) Inventors: Seong-Ryong Park, Daejeon (KR); Ji-Young Kim, Daejeon (KR); Minsung Kim, Daejeon (KR); Young-Jin Baik, Daejeon (KR); Ho-Sang Ra, Daejeon (KR); Jun-Tack Park, Daejeon (KR); Hyung-Kee Yoon, Daejeon (KR); Young-Soo Lee, Seoul (KR); Ki-Chang Chang, Daejeon (KR)

(73) Assignee: KOREA INSTITUTE OF ENERGY RESEARCH, Daejeon (KR)

( * ) Notice: Subject to any disclaimer, the term of this patent is extended or adjusted under 35 U.S.C. 154(b) by 359 days.

(21) Appl. No.: 13/658,150

(22) Filed: Oct. 23, 2012

(65) Prior Publication Data

US 2013/0167581 A1 Jul. 4, 2013

(30) Foreign Application Priority Data

Jan. 2, 2012 (KR) ..... 10-2012-0000050

(51) Int. Cl.
*F25B 43/00* (2006.01)
*F25B 25/02* (2006.01)
(Continued)

(52) U.S. Cl.
CPC ..... *F25B 25/02* (2013.01); *F25B 15/12* (2013.01); *F25B 15/16* (2013.01); *F25B 30/00* (2013.01); *F25B 30/04* (2013.01)

(58) Field of Classification Search
CPC ..... F25B 25/02; F25B 30/04; F25B 15/12; F25B 15/16
USPC ..... 137/625.48
See application file for complete search history.

(56) References Cited

U.S. PATENT DOCUMENTS 2,925,985 A * 2/1960 MacDavid ..... 137/625.48
3,007,543 A * 11/1961 Maher ..... 95/124
(Continued)

FOREIGN PATENT DOCUMENTS

JP 2000-314569 A 11/2000
KR 10-2001-0102493 A 11/2001
(Continued)

OTHER PUBLICATIONS

Machine Translation of KR 10-2005-0090557; retreived on Jan. 2015.*

*Primary Examiner* — Jonathan Bradford
*Assistant Examiner* — Orlando Aviles Bosques
(74) *Attorney, Agent, or Firm* — Paratus Law Group, PLLC

(57) ABSTRACT

A dehumidifier for a compressor, including: a plurality of dehumidifying members that absorb moisture; and a flow passage controlling valve module that enables a low-temperature vapor refrigerant to alternately flow into the plurality of dehumidifying members and enables the low-temperature refrigerant to flow into a compressor in a state where moisture contained in the low-temperature refrigerant is absorbed and is removed, enables a high-temperature vapor refrigerant ejected from the compressor to alternately flow into the dehumidifying members and regenerates the dehumidifying members. Thus, since a liquid-state absorbent contained in a refrigerant flowing into the compressor is removed by the dehumidifier, damage caused by liquid compression and corrosion of the compressor can be reduced. In addition, the structure of the dehumidifier is simple, and an additional external heating source is not required.

4 Claims, 9 Drawing Sheets

(51) Int. Cl.

| | |
|---|---|
| ***F25B 30/04*** | (2006.01) |
| ***F25B 15/12*** | (2006.01) |
| ***F25B 15/16*** | (2006.01) |
| ***F25B 30/00*** | (2006.01) |

(56) References Cited

U.S. PATENT DOCUMENTS 4,877,058 A * 10/1989 Stoll ..... 137/625.48
4,977,745 A * 12/1990 Heichberger ..... 62/619
5,151,288 A * 9/1992 Curry et al. ..... 426/474
5,211,024 A * 5/1993 Manz et al. ..... 62/126
7,266,967 B2 * 9/2007 Inoue et al. ..... 62/238.3

FOREIGN PATENT DOCUMENTS

KR 20-0376219 3/2005
KR 10-0630316 B1 9/2006

* cited by examiner

DEHUMIDIFIER FOR A COMPRESSOR IN COMPRESSION-ABSORPTION HEAT PUMP SYSTEM

CROSS-REFERENCE TO RELATED PATENT APPLICATION

This application claims the benefit of Korean Patent Application No. 10-2012-0000050, filed on Jan. 2, 2012, in the Korean Intellectual Property Office, the disclosure of which is incorporated herein in its entirety by reference.

BACKGROUND OF THE INVENTION

1. Field of the Invention

The present invention relates to a dehumidifier for a compressor, a 1-stage compressing-absorbing type heat pump system, and a 2-stage compressing-absorbing type heat pump system, and more particularly, to a dehumidifier for a compressor in which a damage of the compressor may be reduced, a 1-stage compressing-absorbing type heat pump system, and a 2-stage compressing-absorbing type heat pump system.

2. Description of the Related Art

Heat pumps are devices that produce high-temperature hot water or cold water by using a low-temperature heat source. In particular, Korean Utility-model Registration No. 20-0376219 and Korean Patent Registration No. 10-0630316 that are invented by the present applicant, disclose a hybrid heat pump system that produces high-temperature water and cold water simultaneously. However, in the hybrid heat pump system, since a part of a liquid-state absorbent, for example, water, is contained in a refrigerant that is evaporated by a desorber, the absorbent flows into a compressor together with the refrigerant and thus, the compressor may be damaged.

SUMMARY OF THE INVENTION

The present invention provides a dehumidifier for a compressor in which a damage of the compressor may be reduced, a 1-stage compressing-absorbing type heat pump system, and a 2-stage compressing-absorbing type heat pump system.

According to an aspect of the present invention, there is provided a dehumidifier for a compressor, the dehumidifier including: first and second dehumidifying members that absorb moisture; a first flow passage controlling valve including a first inlet through which a low-temperature vapor refrigerant flows, a second inlet through which a high-temperature and high-pressure vapor refrigerant flows, a first communication pipe that communicates with the first dehumidifying member, and a second communication pipe that communicates with the second dehumidifying member and activating a first operating mode in which the low-temperature refrigerant ejected from the first inlet is discharged to the second dehumidifying member, moisture contained in the low-temperature refrigerant is absorbed and simultaneously the high-temperature refrigerant ejected from the second inlet is discharged to the first dehumidifying member so that the first dehumidifying member is regenerated, and a second operating mode in which the low-temperature refrigerant ejected from the first inlet is discharged to the first dehumidifying member, moisture contained in the low-temperature refrigerant is absorbed and simultaneously the high-temperature refrigerant ejected from the second inlet is discharged to the second dehumidifying member so that the second dehumidifying member is regenerated; and a second flow passage controlling valve including a first outlet that communicates with an inlet of the compressor, a second outlet that communicates with an external device, a third communication pipe that communicates with the first dehumidifying member, and a fourth communication pipe that communicates with the second dehumidifying member, enabling, in the first operating mode, the refrigerant dehumidified by the second dehumidifying member to be discharged to the compressor via the first outlet and the refrigerant used in regenerating the first dehumidifying member to be discharged to the external device via the second outlet, and enabling, in the second operating mode, the refrigerant dehumidified by the first dehumidifying member to be discharged to the compressor via the first outlet and the refrigerant used in regenerating the second dehumidifying member to be discharged to the external device via the second outlet.

The first flow passage controlling valve may include: a first cylinder; a first double head piston that makes forward or backward movement along a lengthwise direction of the first cylinder; a first communication member that is fixed to a middle of the first double head piston, is moved as a one body with the first double head piston, enables, in the first operating mode, the first inlet to communicate with the second communication pipe and enables, in the second operating mode, the first inlet to communicate with the first communication pipe; and a first controller that controls forward or backward movement of the first double head piston.

The second flow passage controlling valve may include: a second cylinder; a second double head piston that makes forward or backward movement along a lengthwise direction of the second cylinder; a second communication member that is fixed to a middle of the second double head piston, is moved as a one body with the second double head piston, enables, in the first operating mode, the first outlet to communicate with the fourth communication pipe and enables, in the second operating mode, the first outlet to communicate with the third communication pipe; and a second controller that controls forward or backward movement of the first double head piston.

Each of the first dehumidifying member and the second dehumidifying member may include a silica gel tube.

According to another aspect of the present invention, there is provided a dehumidifier for a compressor, the dehumidifier including: a plurality of dehumidifying members that absorb moisture; and a flow passage controlling valve module that enables a low-temperature vapor refrigerant to alternately flow into the plurality of dehumidifying members and enables the low-temperature refrigerant to flow into a compressor in a state where moisture contained in the low-temperature refrigerant is absorbed and is removed, enables a high-temperature vapor refrigerant ejected from the compressor to alternately flow into the dehumidifying members and regenerates the dehumidifying members.

According to another aspect of the present invention, there is provided a 1-stage compressing-absorbing type heat pump system, including: an expansion device that expands a high-temperature and high-pressure refrigerant-absorbent mixture and changes the high-temperature and high-pressure refrigerant-absorbent mixture into a low-temperature and low-pressure refrigerant-absorbent mixture; a desorber that receives the low-temperature and low-pressure refrigerant-absorbent mixture from the expansion device and evaporates a part of a refrigerant from the refrigerant-absorbent mixture; a compressor that compresses the refrigerant evaporated by the desorber; a pump that pressurizes the refrigerant-absorbent mixture in a state of a dilute and concentrated solution that remains in a state where a part of the refrigerant is evaporated by the desorber, by using a high-pressure solution; an absorber that absorbs a high-temperature and high-pressure refrigerant ejected from the compressor in a high-pressure refrigerant-absorbent mixture ejected from the pump; and a dehumidifier that absorbs a liquid-state absorbent contained in a low-temperature refrigerant flowing into the compressor and then regenerates the liquid-state absorbent by using the high-temperature and high-pressure refrigerant ejected from the compressor so as to enable the liquid-state absorbent to flow together with the high-temperature and high-pressure refrigerant, wherein the dehumidifier includes: first and second dehumidifying members that absorb moisture; a first flow passage controlling valve including a first inlet through which a low-temperature vapor refrigerant ejected from the desorber flows, a second inlet through which a high-temperature and high-pressure vapor refrigerant ejected from the compressor flows, a first communication pipe that communicates with the first dehumidifying member, and a second communication pipe that communicates with the second dehumidifying member and activating a first operating mode in which the low-temperature refrigerant ejected from the first inlet is discharged to the second dehumidifying member, moisture contained in the low-temperature refrigerant is absorbed and simultaneously the high-temperature refrigerant ejected from the second inlet is discharged to the first dehumidifying member so that the first dehumidifying member is regenerated, and a second operating mode in which the low-temperature refrigerant ejected from the first inlet is discharged to the first dehumidifying member, moisture contained in the low-temperature refrigerant is absorbed and simultaneously the high-temperature refrigerant ejected from the second inlet is discharged to the second dehumidifying member so that the second dehumidifying member is regenerated; and a second flow passage controlling valve including a first outlet that communicates with an inlet of the compressor, a second outlet that communicates with an external device, a third communication pipe that communicates with the first dehumidifying member, and a fourth communication pipe that communicates with the second dehumidifying member, enabling, in the first operating mode, the refrigerant dehumidified by the second dehumidifying member to be discharged to the compressor via the first outlet and the refrigerant used in regenerating the first dehumidifying member to be discharged to the external device via the second outlet, and enabling, in the second operating mode, the refrigerant dehumidified by the first dehumidifying member to be discharged to the compressor via the first outlet and the refrigerant used in regenerating the second dehumidifying member to be discharged to the external device via the second outlet.

According to another aspect of the present invention, there is provided a 2-stage compressing-absorbing type heat pump system, including: an expansion device that expands a high-temperature and high-pressure refrigerant-absorbent mixture and changes the high-temperature and high-pressure refrigerant-absorbent mixture into a low-temperature and low-pressure refrigerant-absorbent mixture; a desorber that receives the low-temperature and low-pressure refrigerant-absorbent mixture from the expansion device and evaporates a part of a refrigerant from the refrigerant-absorbent mixture; a low-pressure compressor that compresses the refrigerant evaporated by the desorber; a pump that pressurizes the refrigerant-absorbent mixture in a state of a dilute and concentrated solution that remains in a state where a part of the refrigerant is evaporated by the desorber, by using a high-pressure solution; an intermediate cooler that mixes an intermediate pressure refrigerant ejected from the low-pressure compressor with the low-temperature refrigerant-absorbent mixture ejected from the pump and diverges and cools a part of the low-temperature refrigerant-absorbent mixture; a high-temperature compressor that compresses a vapor refrigerant in the intermediate cooler; an absorber that absorbs a high-temperature and high-pressure refrigerant ejected from the high-pressure compressor in a high-pressure refrigerant-absorbent mixture ejected from the pump; and a dehumidifier that absorbs a liquid-state absorbent contained a low-temperature refrigerant flowing into the low-pressure compressor and then regenerates the liquid-state absorbent by using the intermediate pressure refrigerant ejected from the low-temperature compressor so as to enable the liquid-state absorbent to flow together with the intermediate pressure refrigerant, wherein the dehumidifier includes: first and second dehumidifying members that absorb moisture; a first flow passage controlling valve including a first inlet through which a low-temperature vapor refrigerant ejected from the desorber flows, a second inlet through which an intermediate pressure vapor refrigerant ejected from the low-temperature compressor flows, a first communication pipe that communicates with the first dehumidifying member, and a second communication pipe that communicates with the second dehumidifying member and activating a first operating mode in which the low-temperature refrigerant ejected from the first inlet is discharged to the second dehumidifying member, moisture contained in the low-temperature refrigerant is absorbed and simultaneously the high-temperature refrigerant ejected from the second inlet is discharged to the first dehumidifying member so that the first dehumidifying member is regenerated, and a second operating mode in which the low-temperature refrigerant ejected from the first inlet is discharged to the first dehumidifying member, moisture contained in the low-temperature refrigerant is absorbed and simultaneously the high-temperature refrigerant ejected from the second inlet is discharged to the second dehumidifying member so that the second dehumidifying member is regenerated; and a second flow passage controlling valve including a first outlet that communicates with an inlet of the low-pressure compressor, a second outlet that communicates with the intermediate cooler, a third communication pipe that communicates with the first dehumidifying member, and a fourth communication pipe that communicates with the second dehumidifying member, enabling, in the first operating mode, the refrigerant dehumidified by the second dehumidifying member to be discharged to the low-pressure compressor via the first outlet and the refrigerant used in regenerating the first dehumidifying member to be discharged to the intermediate cooler via the second outlet, and enabling, in the second operating mode, the refrigerant dehumidified by the first dehumidifying member to be discharged to the low-pressure compressor via the first outlet and the refrigerant used in regenerating the second dehumidifying member to be discharged to the intermediate cooler via the second outlet.

According to another aspect of the present invention, there is provided a 2-stage compressing-absorbing type heat pump system, including: an expansion device that expands a high-temperature and high-pressure refrigerant-absorbent mixture and changes the high-temperature and high-pressure refrigerant-absorbent mixture into a low-temperature and low-pressure refrigerant-absorbent mixture; a desorber that receives the low-temperature and low-pressure refrigerant-absorbent mixture from the expansion device and evaporates a part of a refrigerant from the refrigerant-absorbent mixture; a low-pressure compressor that compresses the refrigerant evaporated by the desorber; a pump that pressurizes the refrigerant-absorbent mixture in a state of a dilute and concentrated solution that remains in a state where a part of the refrigerant is evaporated by the desorber, by using a high-pressure solution; an intermediate cooler that mixes an intermediate pressure refrigerant ejected from the low-pressure compressor with the low-temperature refrigerant-absorbent mixture ejected from the pump and diverges and cools a part of the low-temperature refrigerant-absorbent mixture; a high-temperature compressor that compresses a vapor refrigerant in the intermediate cooler; an absorber that absorbs a high-temperature and high-pressure refrigerant ejected from the high-pressure compressor in a high-pressure refrigerant-absorbent mixture ejected from the pump; and a dehumidifier that absorbs a liquid-state absorbent contained in a low-temperature refrigerant flowing into the low-pressure compressor and then regenerates the liquid-state absorbent by using the high-pressure refrigerant ejected from the high-temperature compressor so as to enable the liquid-state absorbent to flow together with the high-pressure refrigerant, wherein the dehumidifier includes: first and second dehumidifying members that absorb moisture; a first flow passage controlling valve including a first inlet through which a low-temperature vapor refrigerant ejected from the desorber flows, a second inlet through which a high-temperature and high-pressure vapor refrigerant ejected from the high-temperature compressor flows, a first communication pipe that communicates with the first dehumidifying member, and a second communication pipe that communicates with the second dehumidifying member and activating a first operating mode in which the low-temperature refrigerant ejected from the first inlet is discharged to the second dehumidifying member, moisture contained in the low-temperature refrigerant is absorbed and simultaneously the high-temperature refrigerant ejected from the second inlet is discharged to the first dehumidifying member so that the first dehumidifying member is regenerated, and a second operating mode in which the low-temperature refrigerant ejected from the first inlet is discharged to the first dehumidifying member, moisture contained in the low-temperature refrigerant is absorbed and simultaneously the high-temperature refrigerant ejected from the second inlet is discharged to the second dehumidifying member so that the second dehumidifying member is regenerated; and a second flow passage controlling valve including a first outlet that communicates with an inlet of the high-pressure compressor, a second outlet that communicates with the absorber, a third communication pipe that communicates with the first dehumidifying member, and a fourth communication pipe that communicates with the second dehumidifying member, enabling, in the first operating mode, the refrigerant dehumidified by the second dehumidifying member to be discharged to the low-pressure compressor via the first outlet and the refrigerant used in regenerating the first dehumidifying member to be discharged to the absorber via the second outlet, and enabling, in the second operating mode, the refrigerant dehumidified by the first dehumidifying member to be discharged to the low-pressure compressor via the first outlet and the refrigerant used in regenerating the second dehumidifying member to be discharged to the absorber via the second outlet.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
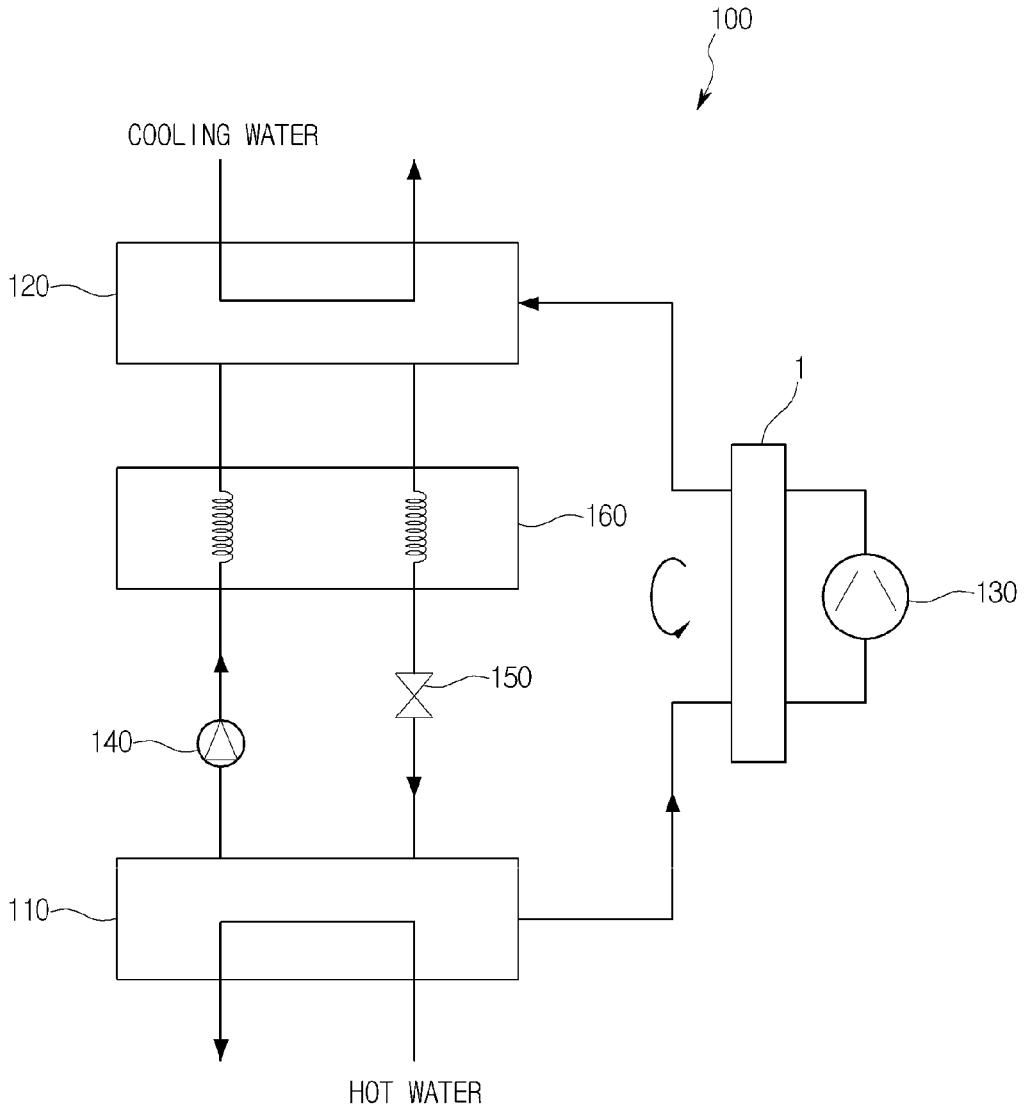
FIG. 1 is a view of a structure of a 1-stage compressing-absorbing type heat pump system according to an embodiment of the present invention.

FIG. 1 illustrates a 1-stage compressing-absorbing type heat pump system 100 according to an embodiment of the present invention. Referring to FIG. 1, the 1-stage compressing-absorbing type heat pump system 100 according to the current embodiment of the present invention includes an expansion device 150, a desorber 110, a compressor 130, a pump 140, an absorber 120, an intermediate heat exchanger 160, and a dehumidifier 1.

The expansion device 150 expands a high-temperature and high-pressure refrigerant-absorbent mixture that is ejected from the absorber 120 so as to change the high-temperature and high-pressure refrigerant-absorbent mixture into a low-temperature and low-pressure refrigerant-absorbent mixture. The refrigerant-absorbent may have various combinations, and a refrigerant-absorbent combination may be a water-LiBr combination, an ammonia-water combination, a R22-DEGDME combination, a R22-DMETEG(E181) combination, a carbon dioxide-acetone combination, a TFE-DMETEG (E181) combination, and the like. In particular, when an ammonia-water combination is used, corrosion resistance and stability may be guaranteed by applying oxide-based nanoparticles excluding a metal base to the ammonia-water combination.

The low-temperature and low-pressure refrigerant-absorbent mixture ejected from the expansion device 150 flows into the desorber 110. Hot water as a heat source is supplied from the outside to the desorber 110, and a refrigerant having a relatively high steam pressure of the refrigerant and the absorbent is mainly evaporated by the desorber 110. The compressor 130 compresses the refrigerant that is evaporated by the desorber 110. The temperature of the hot water is lowered due to heat exchange with the desorber 110, and the hot water of which temperature is lowered, is used as cold water in a demand place.

The pump 140 pressurizes the refrigerant-absorbent mixture that is in the state of a dilute and concentrated solution due to partial evaporation of the refrigerant by the desorber 110 and supplies the pressurized refrigerant-absorbent to the absorber 120. The high-temperature and high-pressure refrigerant that is ejected from the compressor 130, flows into the absorber 120 and is absorbed in the refrigerant-absorbent mixture in the state of the dilute and concentrated solution. Cooling water flows into the absorber 120, and the absorber 120 absorbs heat generated in the absorbing process and dissipates the heat to the outside. By absorbing the heat, the temperature of the cooling water increases. The cooling water of which temperature increases, is used as hot water in a demand place.

The intermediate heat exchanger 160 heat-exchanges the high-temperature and high-pressure refrigerant-absorbent mixture that is ejected from the pump 140 and flows into the absorber 120 with the high-pressure refrigerant-absorbent mixture that is ejected from the absorber 120 and flows into the expansion device 150.

A part of a liquid-state absorbent is contained in the refrigerant that flows into the compressor 130. About 0.3% water may be contained in an ammonia-water combination. When the absorbent flows into the compressor 130, liquid compression occurs in the compressor 130, and thus the compressor 130 may be damaged. In addition, since the compressor 130 includes material, such as iron, or the like, when the absorbent flows into the compressor 130, there is a large possibility that the compressor 130 may be corroded.

Figure 2:
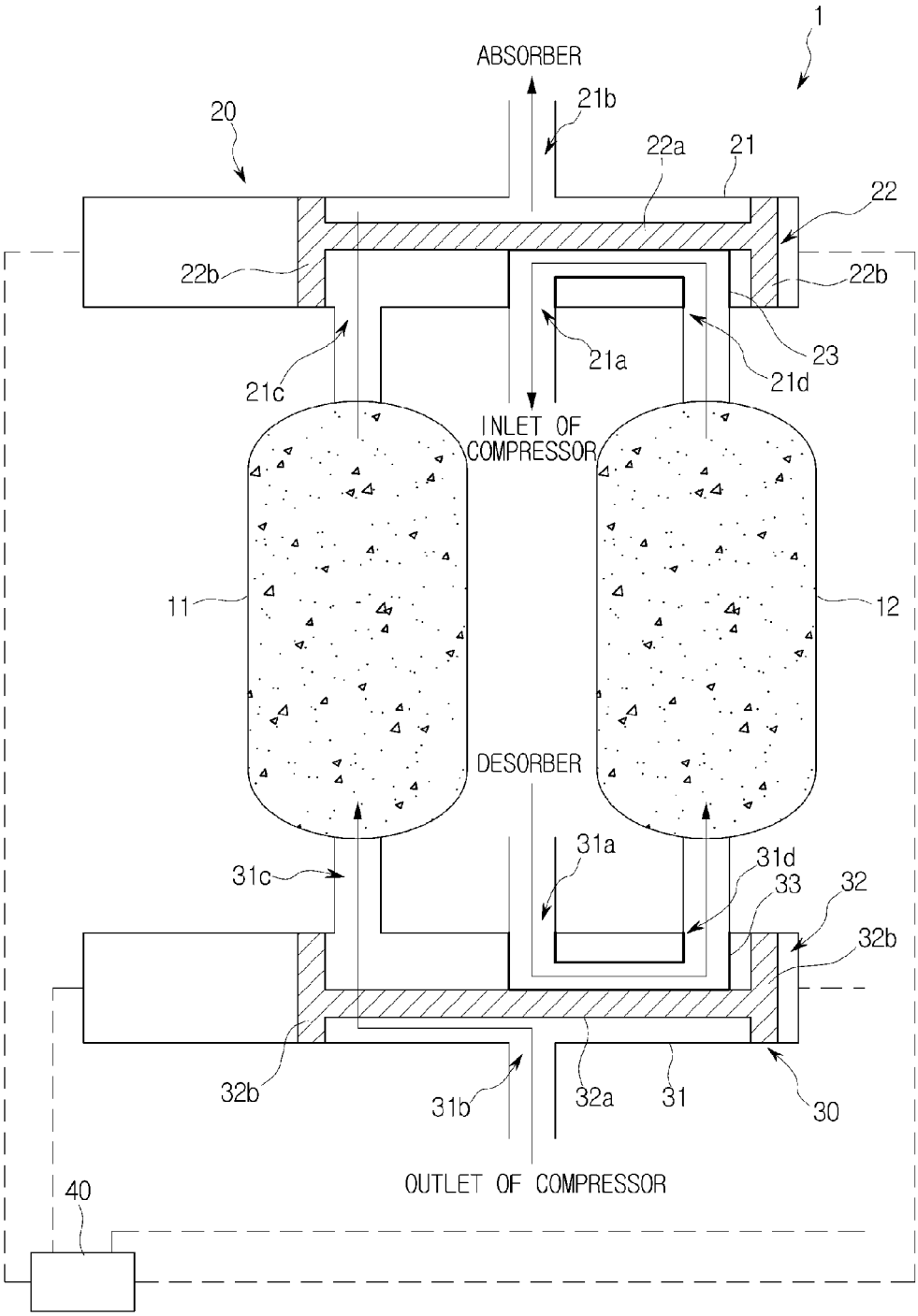
FIG. 2 is a view of a flow structure of a refrigerant in a first operating mode of a dehumidifier illustrated in FIG. 1.
Figure 3:
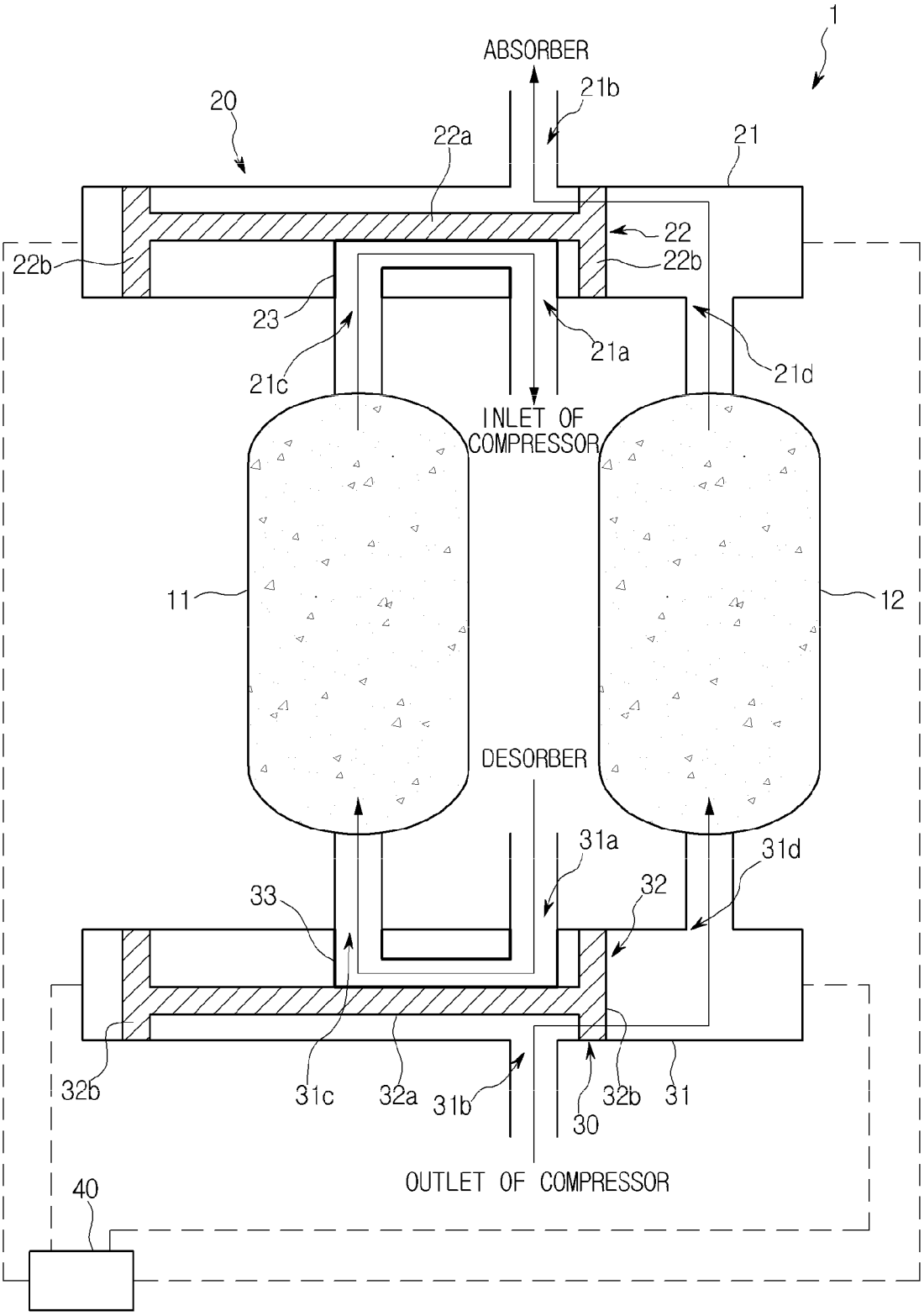
FIG. 3 is a view of a flow structure of a refrigerant in a second operating mode of the dehumidifier illustrated in FIG. 1.

The dehumidifier 1 is installed in order to solve the problem. The dehumidifier 1 absorbs the liquid-state absorbent. After the dehumidifier 1 is rotated, the absorbent that is absorbed by the dehumidifier 1, is regenerated by the high-temperature and high-pressure refrigerant that is ejected from the compressor 130 and flows into the absorber 120 together with the high-temperature and high-pressure refrigerant. Hereinafter, the dehumidifier 1 will be described in detail with reference to FIGS. 2 and 3. FIG. 2 is a view of a flow structure of a refrigerant in a first operating mode of a dehumidifier illustrated in FIG. 1, and FIG. 3 is a view of a flow structure of a refrigerant in a second operating mode of the dehumidifier illustrated in FIG. 1.

The dehumidifier 1 includes first and second dehumidifying members 11 and 12 and first and second flow passage controlling valves 30 and 20. The first and second dehumidifying members 11 and 12 include silica gel tubes and have the same structures. The first and second flow passage controlling valves 30 and 20 constitute a flow passage controlling valve module.

The first flow passage controlling valve 30 includes a first cylinder 31, a first double head piston 32, a first communication member 33, and a first controller (not shown). The first cylinder 31 is long in its lengthwise direction. The first cylinder 31 includes a first inlet 31*a* through which the low-temperature vapor refrigerant from the desorber 110 flows, a second inlet 31*b* through which the high-temperature and high-pressure vapor refrigerant ejected from the compressor 130 flows, a first communication pipe 31*c* that communicates with the first dehumidifying member 11, and a second communication pipe 31*d* that communicates with the second dehumidifying member 12.

The first double head piston 32 is disposed in the first cylinder 31 and makes forward or backward movement along a lengthwise direction of the first cylinder 31. The first double head piston 32 has a structure in which two heads 32*b* are fixed to both sides of a shaft 32*a*.

The first communication member 33 is fixed to the shaft 32*a* of the first double head piston 32 and is moved as a one body with the first double head piston 32, allows the first inlet 31*a* to communicate with the second communication pipe 31*d* in the first operating mode, and allows the first inlet 31*a* to communicate with the first communication pipe 31*c* in the second operating mode.

The first controller (not shown) enables compressed air to flow between both ends of the first cylinder 31 and two heads 32*b* of the first double head piston 32 and enables the first double head piston 32 to make forward or backward movement along the lengthwise direction by using a pressure difference in the first cylinder 31. As the first double head piston 32 makes forward or backward movement, the first operating mode and the second operating mode are alternately activated.

The second flow passage controlling valve 20 includes a second cylinder 21, a second double head piston 22, a second communication member 23, and a second controller (not shown). The second cylinder 21 is long in its lengthwise direction. The second cylinder 21 includes a first outlet 21*a* that communicates with an inlet of the compressor 130, a second outlet 21*b* that communicates with the absorber 120, a third communication pipe 21*c* that communicates with the first dehumidifying member 11, and a fourth communication pipe 21*d* that communicates with the second dehumidifying member 12.

The second double head piston 22 is disposed in the second cylinder 21 and makes forward or backward movement along a lengthwise direction of the second cylinder 21. The second double head position 22 has a structure in which two heads 22*b* are fixed to both sides of a shaft 22*a*.

The second communication member 23 is fixed to the shaft 22*a* of the second double head piston 22 and is moved as a one body with the second double head piston 22. The second communication member 23 allows the first outlet 21*a* to communicate with the fourth communication pipe 21*d* in the first operating mode and allows the first outlet 21*a* to communicate with the third communication pipe 21*c* in the second operating mode.

The second controller (not shown) enables compressed air to flow between both ends of the second cylinder 21 and two heads 22*b* of the second double head piston 22 and enables the second double head piston 22 to make forward or backward movement along the lengthwise direction by using a pressure difference in the second cylinder 21. As the second double head piston 22 makes forward or backward movement, the first operating mode and the second operating mode are alternately activated. The first controller (not shown) and the second controller (not shown) may be separated from each other; however, in the present embodiment, the first controller (not shown) and the second controller (not shown) constitute a one body type control module 40.

First, in the first operating mode (see FIG. 2), due to an operation of the control module 40, the first communication member 33 enables the first inlet 31*a* to communicate with the second communication pipe 31*d*, and the second communication member 23 enables the first outlet 21*a* to communicate with the fourth communication pipe 21*d*. The low-temperature and low-pressure refrigerant that is ejected from the desorber 110 via the first inlet 31*a*, flows into the second dehumidifying member 12. The second dehumidifying member 12 absorbs a liquid absorbent contained in the refrigerant. Thus, the refrigerant from which the absorbent is removed, flows into the second flow passage controlling valve 20 via the fourth communication pipe 21*d* and then flows into the compressor 130 via the first inlet 21*a*. Simultaneously, the high-temperature and high-pressure refrigerant that flows into the second inlet 31*b*, is led to the first dehumidifying member 11. The absorbent that is absorbed by the first dehumidifying member 11, is regenerated and evaporated by the high-temperature and high-pressure refrigerant and flows into the absorber 120 together with the refrigerant via the second flow passage controlling valve 30.

Contrary to the first operating mode, in the second operating mode (see FIG. 3), the first dehumidifying member 11 absorbs the absorbent, and the second dehumidifying member 12 regenerates the absorbent.

As described above, since the absorbent that flows into the compressor 130 is removed by the dehumidifier 1, problems relating to liquid compression and corrosion of the compressor 130 may be easily solved, and an additional, external heating source is not required.

Figure 4:
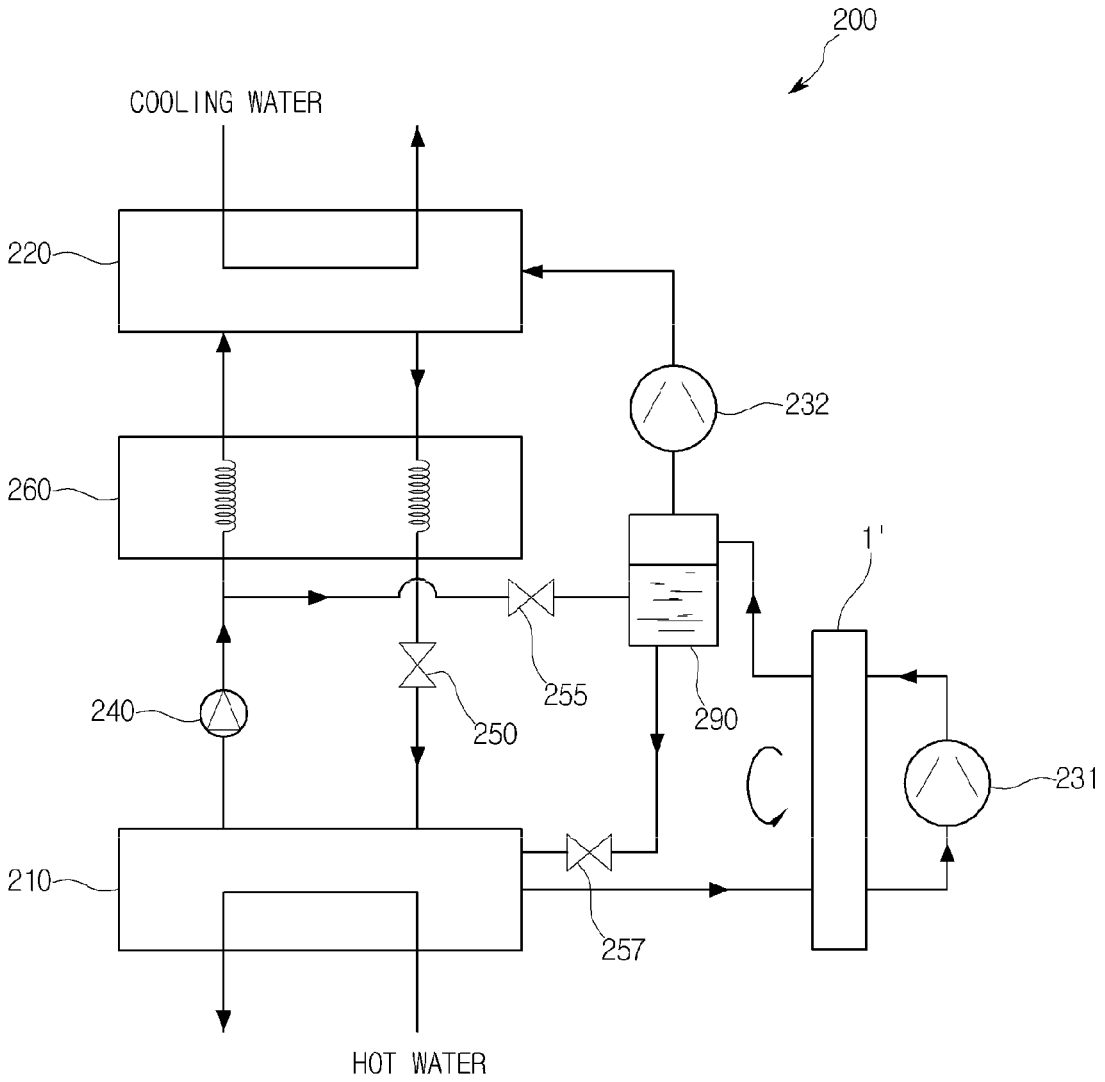
FIG. 4 is a view of a structure of a 2-stage compressing-absorbing type heat pump system according to another embodiment of the present invention.

FIG. 4 illustrates a 2-stage compressing-absorbing type heat pump system 200 according to another embodiment of the present invention. Like reference numerals of FIG. 4 that are the same as those of FIG. 1, denote like elements. Hereinafter, differences between FIGS. 1 and 4 will be described.

Referring to FIG. 4, the 2-stage compressing-absorbing type heat pump system 200 according to the current embodiment of the present invention includes an expansion device 250, a desorber 210, a low-pressure compressor 231, a high-pressure compressor 232, an intermediate cooling controlling valve 255, a solution return valve 257, a pump 240, an absorber 220, an intermediate heat exchanger 260, an intermediate cooler 290, and a dehumidifier 1'.

The expansion device 250 expands a high-temperature and high-pressure refrigerant-absorbent mixture that is ejected in from the absorber 220, so as to change the high-temperature and high-pressure refrigerant-absorbent mixture into a low-temperature and low-pressure refrigerant-absorbent mixture.

The low-temperature and low-pressure refrigerant-absorbent mixture from the expansion device 250 flows into the desorber 210. Hot water as a heat source is supplied from the outside to the desorber 210, and a refrigerant having a relatively high steam pressure of the refrigerant and the absorbent is mainly evaporated by the desorber 210. The temperature of the hot water is lowered due to heat exchange with the desorber 210, and the hot water of which temperature is lowered, is used as cold water in a demand place.

The low-pressure compressor 231 compresses the refrigerant that is evaporated by the desorber 210 and enables the refrigerant to flow into the intermediate cooler 290. The pump 240 pressurizes refrigerant-absorbent mixture that is in the state of a dilute and concentrated solution due to partial evaporation of the refrigerant by the desorber 210 and supplies the pressurized refrigerant-absorbent to the absorber 220. In addition, a part of the low-temperature refrigerant-absorbent mixture that is ejected from the pump 240, is diverged by the intermediate cooler 290 and flows into the intermediate cooler 290. The intermediate cooling controlling valve 255 controls a flow rate of the refrigerant-absorbent mixture that flows into the intermediate cooler 290.

The intermediate cooler 290 mixes an intermediate pressure refrigerant that is ejected from the low-pressure compressor 231, with the low-temperature refrigerant-absorbent mixture that is ejected from the pump 240, and a temperature of the intermediate cooler 290 is lowered. The intermediate cooler 290 is a flash type. A liquid-state refrigerant-absorbent mixture in the intermediate cooler 290 is depressurized at the solution return valve 257 and is recovered by the desorber 210. A vapor refrigerant in the intermediate cooler 290 flows into the high-pressure compressor 232 and is compressed by the high-pressure compressor 232 and then flows into the absorber 220. Due to the intermediate cooler 290, a compressor work of the high-pressure compressor 232 is reduced.

The high-temperature and high-pressure refrigerant that is ejected from the high-pressure compressor 232, flows into the absorber 220 and is absorbed in the refrigerant-absorbent mixture in the state of the dilute concentrated solution that is ejected from the pump 240. Cooling water flows into the absorber 220, and the absorber 220 absorbs heat generated in the absorbing process and dissipates heat to the outside. By absorbing heat, the temperature of the cooling water increases. The cooling water of which temperature increases, is used as hot water in a demand place.

The intermediate heat exchanger 260 heat-exchanges the high-temperature and high-pressure refrigerant-absorbent mixture that is ejected from the pump 240 and flows into the absorber 220 with the high-pressure refrigerant-absorbent mixture that is ejected from the absorber 220 and flows into the expansion device 250.

Figure 5:
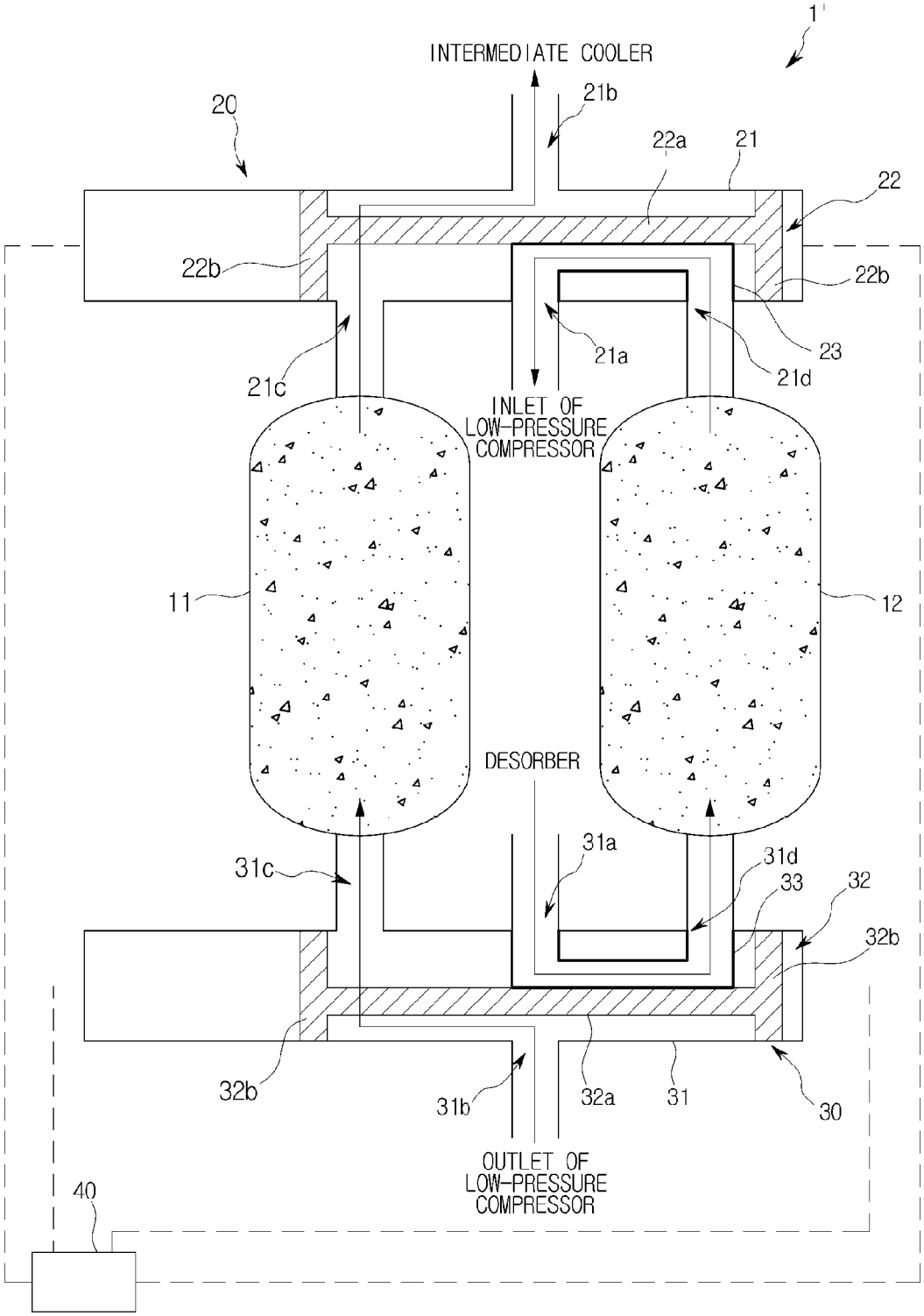
FIG. 5 is a view of a flow structure of a refrigerant in a first operating mode of a dehumidifier illustrated in FIG. 4.
Figure 6:
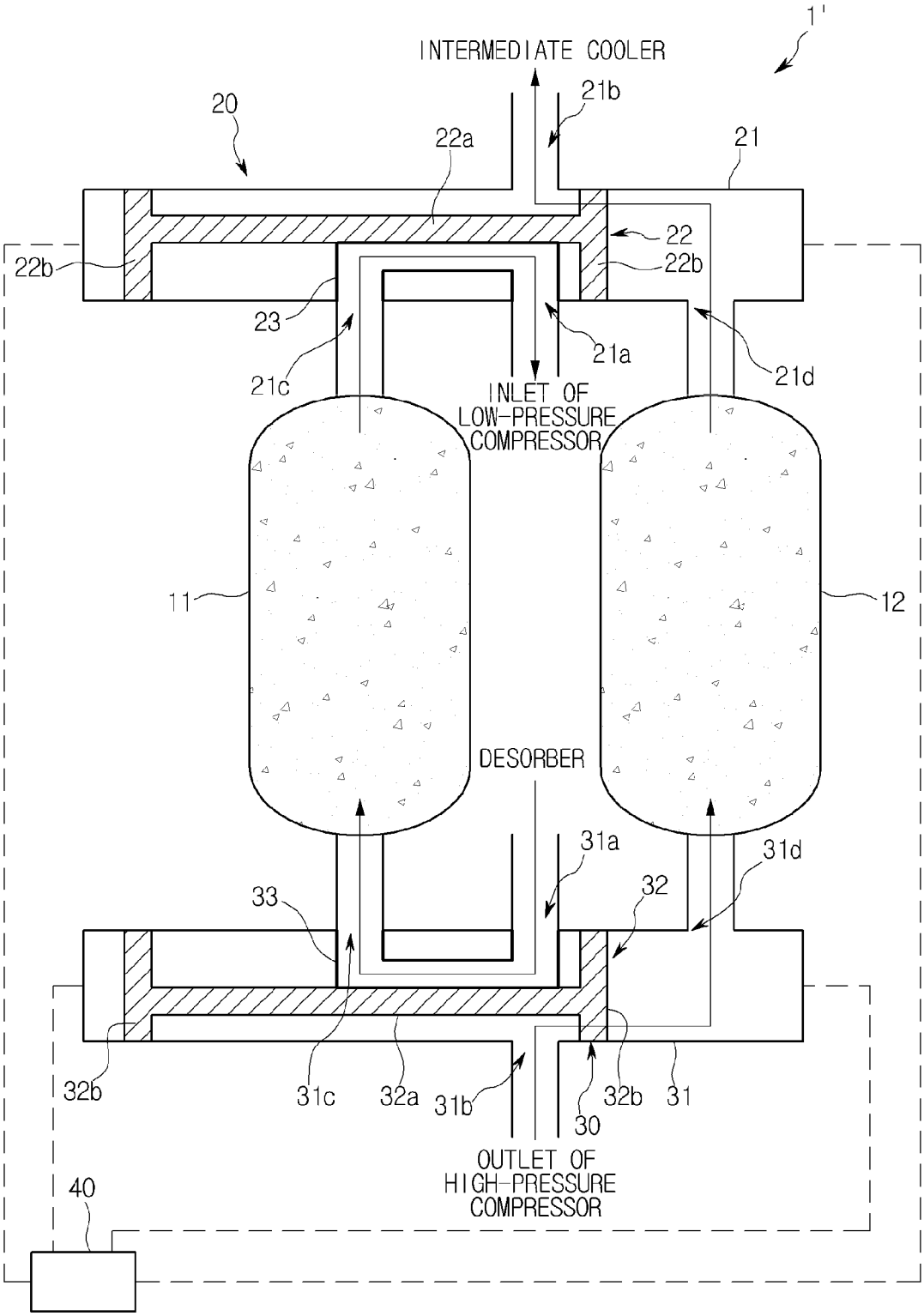
FIG. 6 is a view of a flow structure of a refrigerant in a second operating mode of the dehumidifier illustrated in FIG. 4.

The dehumidifier 1' absorbs the liquid-state absorbent contained in the refrigerant that flows into the low-pressure compressor 231. FIGS. 5 and 6 illustrate a flow structure of a refrigerant in each of a first operating mode and in a second operation mode of the dehumidifier 1'. Like reference numerals of FIGS. 5 and 6 that are the same as those of FIGS. 2 and 4, denote like elements.

In the dehumidifier 1', the low-temperature and low-pressure refrigerant from the desorber 210 flows into a first inlet 31*a*, and the intermediate pressure refrigerant from the low-pressure compressor 231 flows into a second inlet 31*b*. In addition, the first inlet 31*a* communicates with an inlet of the low-pressure compressor 231, and the second inlet 31*b* communicates with the intermediate cooler 290. Excluding the refrigerant inflow and outflow structure, structure and operation of the dehumidifier 1' are substantially the same as the structure and operation of the dehumidifier 1 illustrated in FIG. 2 or 3 and thus detailed descriptions of a configuration of the dehumidifier 1' will be omitted.

First, in the first operating mode (see FIG. 5), due to an operation of a control module 40, a first communication member 33 enables the first inlet 31*a* to communicate with a second communication pipe 31*d*, and a second communication member 23 enables a first outlet 21*a* to communicate with a fourth communication pipe 21*d*. The low-temperature and low-pressure refrigerant that flows into the first inlet 31*a* from the desorber 110, flows into a second dehumidifying member 12. The second dehumidifying member 12 absorbs a liquid absorbent contained in the refrigerant. Thus, the refrigerant from which the absorbent is removed, flows into a second flow passage controlling valve 20 via the fourth communication pipe 21*d* and then flows into the low-pressure compressor 130 via the first inlet 21*a*. Simultaneously, the intermediate pressure refrigerant that flows into the second inlet 31*b*, is led to the first dehumidifying member 11. The absorbent that is absorbed by the first dehumidifying member 11, is regenerated and evaporated by the intermediate pressure refrigerant and flows into the intermediate cooler 290 together with the refrigerant via a second flow passage controlling valve 30.

Contrary to the first operating mode, in the second operating mode (see FIG. 6), the first dehumidifying member 11 absorbs the absorbent, and the second dehumidifying member 12 regenerates the absorbent.

Figure 7:
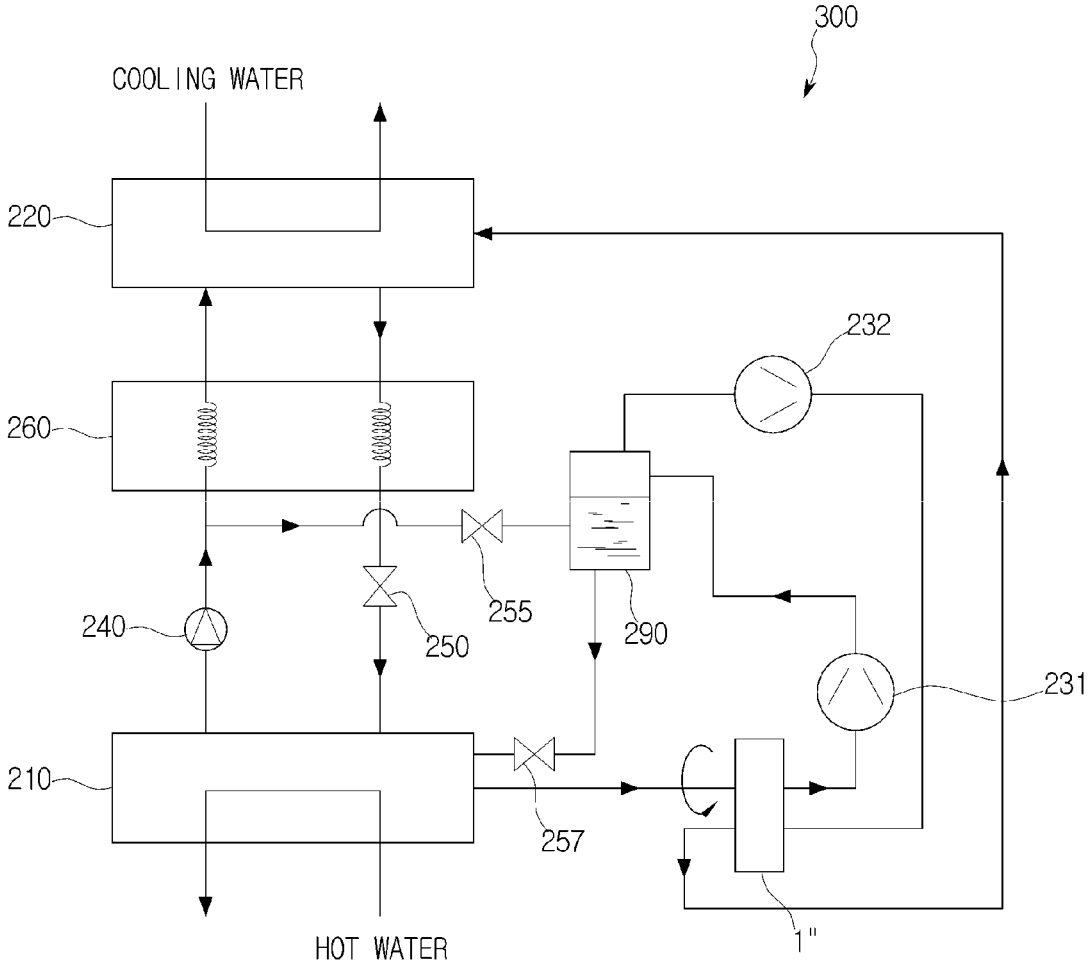
FIG. 7 is a view of a structure of the 2-stage compressing-absorbing type heat pump system illustrated in FIG. 4 according to a modified example.

FIG. 7 is a view of a structure of the 2-stage compressing-absorbing type heat pump system 200 illustrated in FIG. 4 according to a modified example. Like reference numerals of FIG. 7 that are the same as those of FIG. 4, denote like elements. Hereinafter, differences between FIGS. 4 and 7 will be described.

Figure 8:
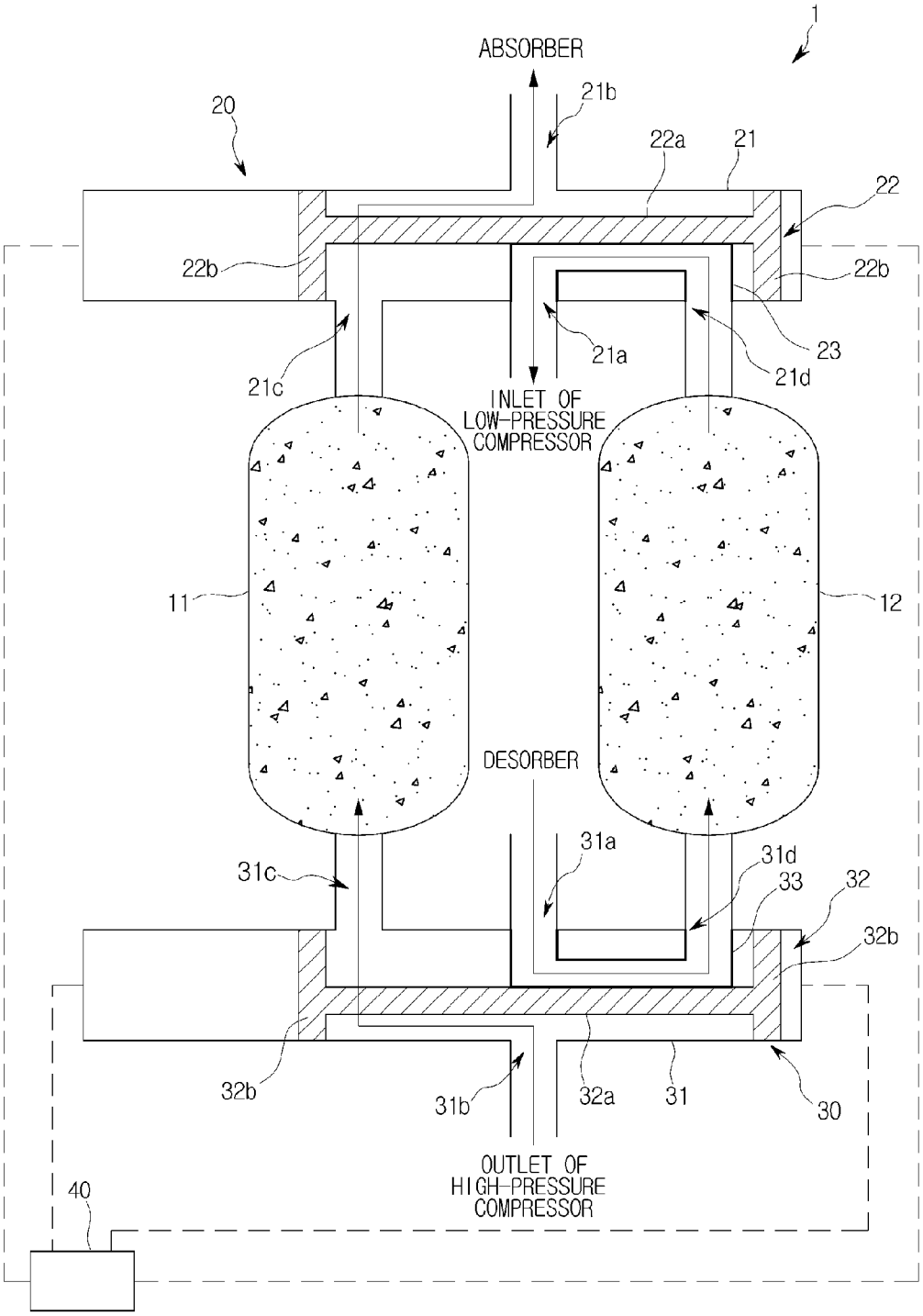
FIG. 8 is a view of a flow structure of a refrigerant in a first operating mode of a dehumidifier illustrated in FIG. 7.
Figure 9:
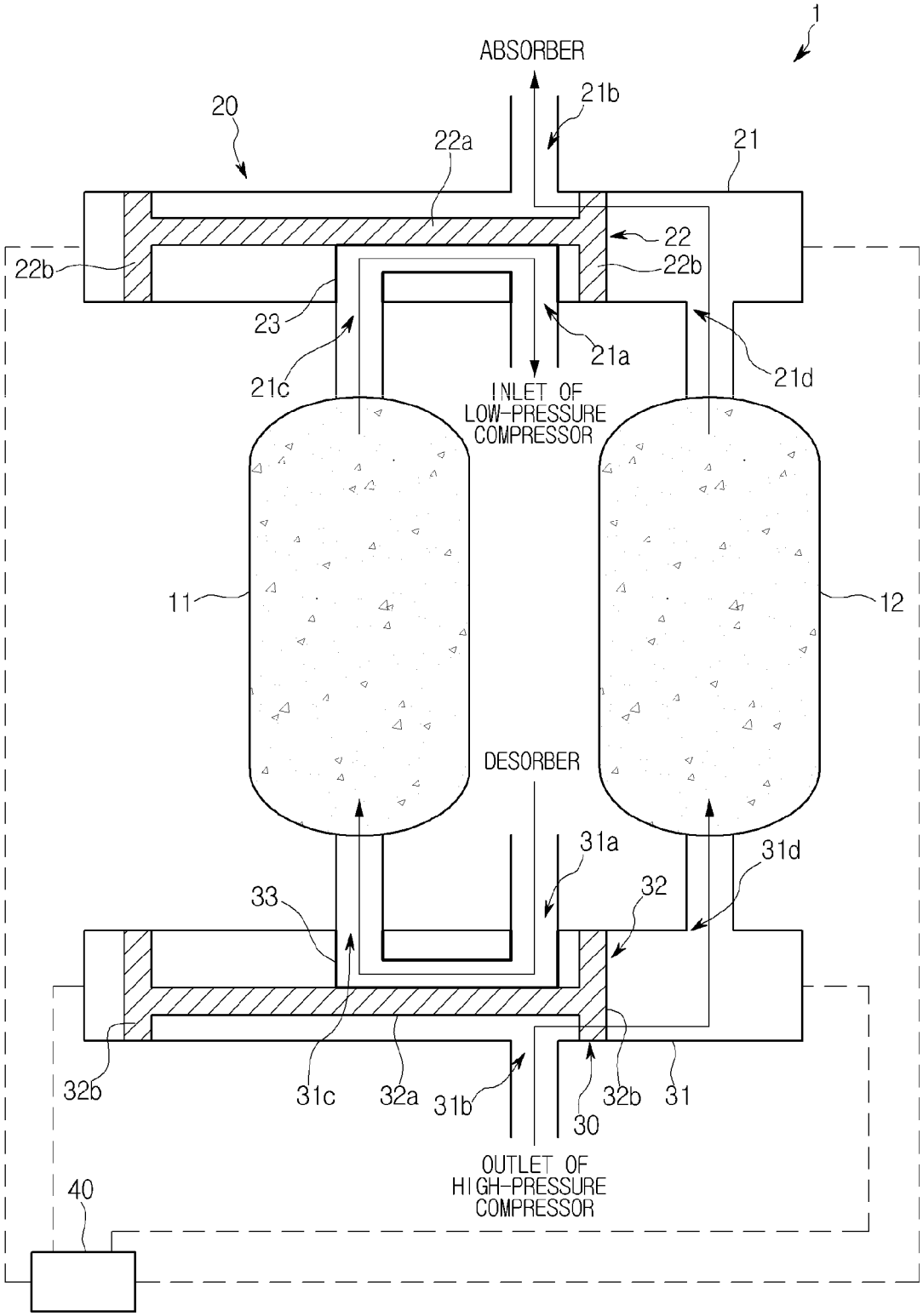
FIG. 9 is a view of a flow structure of a refrigerant in a second operating mode of the dehumidifier illustrated in FIG. 7.

The difference between a 2-stage compressing-absorbing type heat pump system 300 of FIG. 7 and the 2-stage compressing-absorbing type heat pump system 200 of FIG. 4 is a regeneration heat source of a dehumidifier 1". The dehumidifier 1" absorbs a liquid-state absorbent contained in a refrigerant that flows into a low-pressure compressor 231. The absorbent absorbed by the dehumidifier 1" is regenerated by the high-temperature and high-pressure refrigerant that is ejected from a high-pressure compressor 232 and flows into the absorber 220 together with the high-temperature and high-pressure refrigerant. While the regeneration process is performed, the temperature of the refrigerant is higher than the temperature of the refrigerant of the dehumidifier 1' of FIG. 4. Thus, a dehumidifying performance of the dehumidifier 1" is further improved. This will be described in more detail with reference to FIGS. 8 and 9.

First, in a first operating mode (see FIG. 8), due to an operation of a control module 40, a first communication member 33 enables a first inlet 31*a* to communicate with a second communication pipe 31*d*, and a second communication member 23 enables a first outlet 21*a* to communicate with a fourth communication pipe 21*d*. A low-temperature and low-pressure refrigerant that flows into the first inlet 31*a* from a desorber 110, flows into a second dehumidifying member 12. The second dehumidifying member 12 absorbs a liquid absorbent contained in the refrigerant. Thus, the refrigerant from which the absorbent is removed, flows into a second flow passage controlling valve 20 via the fourth communication pipe 21*d* and then flows into the low-pressure compressor 231 via the first inlet 21*a*. Simultaneously, a high-temperature and high-pressure refrigerant from the high-pressure compressor 232 is led to a first dehumidifying member 11 via the second inlet 31*b*. The absorbent that is absorbed by the first dehumidifying member 11, is regenerated and evaporated by the high-temperature and high-pressure refrigerant and flows into the absorber 220 together with the refrigerant via a second flow passage controlling valve 30.

Contrary to the first operating mode, in a second operating mode (see FIG. 9), the first dehumidifying member 11 absorbs the absorbent, and the second dehumidifying member 12 regenerates the absorbent.

As described above, a dehumidifier for a compressor, a 1-stage compressing-absorbing type heat pump system, and a 2-stage compressing-absorbing type heat pump system according to the one or more embodiments of the present invention have the following effects.

First, since a liquid-state absorbent contained in a refrigerant that flows into a compressor (low-pressure compressor) is removed by the dehumidifier, damage caused by liquid compression of the compressor can be reduced.

Second, since a liquid-state absorbent contained in a refrigerant that flows into the compressor (low-pressure compressor) is removed by the dehumidifier, a possibility that the compressor may be corroded, can be reduced.

Third, the structure of the dehumidifier is simple, and a possibility of leakage to the outside can be reduced, and an additional, external heat source is not required.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A dehumidifier for a compressor, the dehumidifier comprising:

a first dehumidifying member and a second dehumidifying member configured to absorb moisture;

a first flow passage controlling valve comprising a first inlet through which a low-temperature vapor refrigerant flows, and a second inlet through which a high-temperature and high-pressure vapor refrigerant flows, a first communication pipe configured to communicate with the first dehumidifying member, and a second communication pipe configured to communicate with the second dehumidifying member, wherein a first operating mode is activated by ejecting low-temperature refrigerant from the first inlet which is discharged to the second dehumidifying member, wherein moisture contained in the low-temperature refrigerant is absorbed and the high-temperature refrigerant is simultaneously ejected from the second inlet that is discharged to the first dehumidifying member so that the first dehumidifying member is regenerated, and a second operating mode is activated by ejecting low-temperature refrigerant from the first inlet which is discharged to the first dehumidifying member, wherein moisture contained in the low-temperature refrigerant is absorbed and the high-temperature refrigerant is simultaneously ejected from the second inlet that is discharged to the second dehumidifying member so that the second dehumidifying member is regenerated, wherein the first flow passage controlling valve further comprises:

a first cylinder;

a first double head piston having two ends each having a single piston head operated in forward or backward movement along a horizontal direction within the first cylinder;

a first communication member, fixed to a middle of the first double head piston, moving as a one body with the first double head piston in the first operating mode, the first inlet communicating with the first communication pipe in the second operating mode, a first controller configured to control forward or backward movement of the first double head piston, wherein the first operating mode and the second operating mode are alternately activated by forward or backward movement of the first double head piston; and a second flow passage controlling valve comprising a first outlet that communicates with an inlet of the compressor, a second outlet that communicates with an external device, a third communication pipe that communicates with the first dehumidifying member, and a fourth communication pipe that communicates with the second dehumidifying member, wherein the second flow passage controlling valve further comprises:

a second cylinder;

a second double head piston having two ends each having a single piston head operated in forward or backward movement along the horizontal direction within the second cylinder;

a second communication member, fixed to a middle of the second double head piston, moving as a one body with the second double head piston in the first operating mode, the second inlet communicating with the second communication pipe in the second operating mode, a second controller configured to control forward or backward movement of the second double head piston, wherein the first flow passage controlling valve is arranged at an upper portion of the first and second dehumidifying members, and the second flow passage controlling valve is arranged at a lower portion of the first and second dehumidifying members, and the first double head piston is symmetrically arranged with the second double head piston, and wherein the first operating mode is enabled in which the refrigerant dehumidified by the second dehumidifying member is discharged to the compressor via the first outlet and the refrigerant used in regenerating the first dehumidifying member is discharged to the external device via the second outlet, and the second operating mode is enabled in which the refrigerant dehumidified by the first dehumidifying member is discharged to the compressor via the first outlet and the refrigerant used in regenerating the second dehumidifying member is discharged to the external device via the second outlet.

2. The dehumidifier for a compressor of claim 1, wherein each of the first dehumidifying member and the second dehumidifying member comprises a silica gel tube.

3. A 2-stage compressing-absorbing type heat pump system, the system comprising:

an expansion device configured to expand a high-temperature and high-pressure refrigerant-absorbent mixture, wherein the high-temperature and high-pressure refrigerant-absorbent mixture are changed into a low-temperature and low-pressure refrigerant-absorbent mixture;

a desorber configured to receive the low-temperature and low-pressure refrigerant-absorbent mixture from the expansion device and to evaporate a part of a refrigerant from the refrigerant-absorbent mixture;

a low-pressure compressor configured to compress the refrigerant evaporated by the desorber;

a pump configured to pressurize the refrigerant-absorbent mixture in a state of a dilute and concentrated solution that remains in a state where a part of the refrigerant is evaporated by the desorber by using a high-pressure solution;

an intermediate cooler configured to mix an intermediate pressure refrigerant ejected from the low-pressure compressor with the low-temperature refrigerant-absorbent mixture ejected from the pump and diverges and cools a part of the low-temperature refrigerant-absorbent mixture;

a high-temperature compressor configured to compress a vapor refrigerant in the intermediate cooler;

an absorber configured to absorb a high-temperature and high-pressure refrigerant ejected from the high-pressure compressor in a high-pressure refrigerant-absorbent mixture ejected from the pump; and a dehumidifier configured to absorb a liquid-state absorbent contained in a low-temperature refrigerant flowing into the low-pressure compressor and to regenerate the liquid-state absorbent by using the high-pressure refrigerant ejected from the high-temperature compressor so as to enable the liquid-state absorbent to flow together with the high-pressure refrigerant, wherein the dehumidifier comprises:

a first dehumidifying member and a second dehumidifying member configured to absorb moisture;

a first flow passage controlling valve comprising a first inlet through which a low-temperature vapor refrigerant ejected from the desorber flows, a second inlet through which a high-temperature and high-pressure vapor refrigerant ejected from the high-temperature compressor flows, a first communication pipe configured to communicate with the first dehumidifying member, and a second communication pipe configured to communicate with the second dehumidifying member, a first operating mode is activated by ejecting low-temperature refrigerant from the first inlet which is discharged to the second dehumidifying member, wherein moisture contained in the low-temperature refrigerant is absorbed and the high-temperature refrigerant is simultaneously ejected from the second inlet that is discharged to the first dehumidifying member so that the first dehumidifying member is regenerated, and a second operating mode is activated by low-temperature refrigerant ejected from the first inlet which is discharged to the first dehumidifying member, wherein moisture contained in the low-temperature refrigerant is absorbed and the high-temperature refrigerant is simultaneously ejected from the second inlet that is discharged to the second dehumidifying member so that the second dehumidifying member is regenerated, wherein the first flow passage controlling valve further comprises:

a first cylinder;

a first double head piston having two ends each having a single piston head operated in forward or backward movement along a horizontal direction within the first cylinder;

a first communication member, fixed to a middle of the first double head piston, moving as a one body with the first double head piston in the first operating mode, the first inlet communicating with the first communication pipe in the second operating mode, a first controller configured to control forward or backward movement of the first double head piston, wherein the first operating mode and the second operating mode are alternately activated by forward or backward movement of the first double head piston; and a second flow passage controlling valve comprising a first outlet that communicates with an inlet of the high-pressure compressor, a second outlet that communicates with the absorber, a third communication pipe that communicates with the first dehumidifying member, and a fourth communication pipe that communicates with the second dehumidifying member, wherein the second flow passage controlling valve further comprises:

a second cylinder;

a second double head piston having two ends each having a single piston head operated in forward or backward movement along the horizontal direction within the second cylinder;

a second communication member, fixed to a middle of the second double head piston, moving as a one body with the second double head piston in the first operating mode, the second inlet communicating with the second communication pipe in the second operating mode, a second controller configured to control forward or backward movement of the second double head piston, wherein the first flow passage controlling valve is arranged at an upper portion of the first and second dehumidifying members, and the second flow passage controlling valve is arranged at a lower portion of the first and second dehumidifying members, and the first double head piston is symmetrically arranged with the second double head piston, and wherein when the first operating mode is enabled in which the refrigerant dehumidified by the second dehumidifying member is discharged to the low-pressure compressor via the first outlet and the refrigerant used in regenerating the first dehumidifying member is discharged to the absorber via the second outlet, and when the second operating mode is enabled in which the refrigerant dehumidified by the first dehumidifying member is discharged to the low-pressure compressor via the first outlet and the refrigerant used in regenerating the second dehumidifying member is discharged to the external device via the second outlet.

4. The 2-stage compressing-absorbing type heat pump system of claim 3, further comprising:

a heat exchanger configured to exchange heat between the high-temperature and high-pressure refrigerant-absorbent mixture that is ejected from the pump, the high-pressure refrigerant-absorbent mixture being flown into the absorber with the high-pressure refrigerant-absorbent mixture ejected from the absorber being flown into the expansion device.

* * * * *